United States Patent [19]

Degnan et al.

[11] Patent Number: 4,498,976

[45] Date of Patent: Feb. 12, 1985

[54] SUPPRESSION OF LIGHT GAS PRODUCTION IN CRACKING PROCESSES BY THE ADDITION OF HIGHLY SILICEOUS MATERIALS HAVING HIGH SURFACE AREA AND LOW ACIDITY

[75] Inventors: Thomas F. Degnan, Yardley, Pa.; Randall D. Partridge, Princeton, N.J.

[73] Assignee: Mobil Oil Corporation, New York, N.Y.

[21] Appl. No.: 368,548

[22] Filed: Apr. 15, 1982

[51] Int. Cl.[3] ..... C10G 11/02

[52] U.S. Cl. ..... 208/120; 208/106

[58] Field of Search ..... 208/120, 106

[56] References Cited

U.S. PATENT DOCUMENTS

| | | | |
|---|---|---|---|
| 3,442,795 | 5/1969 | Kerr et al. | 208/120 |
| 3,506,400 | 4/1970 | Eberly et al. | 423/328 |
| 3,551,353 | 10/1968 | Chen et al. | 208/120 |
| 3,591,488 | 7/1971 | Eberly, Jr. et al. | 208/120 |
| 3,649,521 | 3/1972 | Martin | 208/120 |
| 3,849,291 | 11/1974 | Owen | 208/78 |
| 4,046,670 | 9/1977 | Seguchi et al. | 208/48 AA |
| 4,093,560 | 6/1978 | Kerr et al. | 208/120 |
| 4,263,126 | 4/1981 | Rollmann | 208/120 |
| 4,297,335 | 10/1981 | Lok et al. | 502/60 |
| 4,299,685 | 11/1981 | Khulbe et al. | 208/48 AA |
| 4,309,280 | 1/1982 | Rosinski et al. | 208/120 |
| 4,316,794 | 2/1982 | Schoennagel | 208/120 |
| 4,340,465 | 7/1982 | Miller et al. | 502/65 |
| 4,354,924 | 10/1982 | Miller | 208/120 |
| 4,368,114 | 1/1983 | Chester et al. | 208/120 |

*Primary Examiner*—Curtis R. Davis
*Assistant Examiner*—Lance Johnson
*Attorney, Agent, or Firm*—Alexander J. McKillop; Michael G. Gilman; Laurence P. Hobbes

[57] ABSTRACT

A method for suppressing light gas production in a cracking process by dispersing in the feed low concentrations of a highly siliceous material having high surface area and low acidity prior to cracking. Because of the high surface area-to-volume ratio of the particles, the catalyst acts as a free radical scavenger which reduces the amount of light gas produced by free radical-promoted reactions.

13 Claims, 1 Drawing Figure

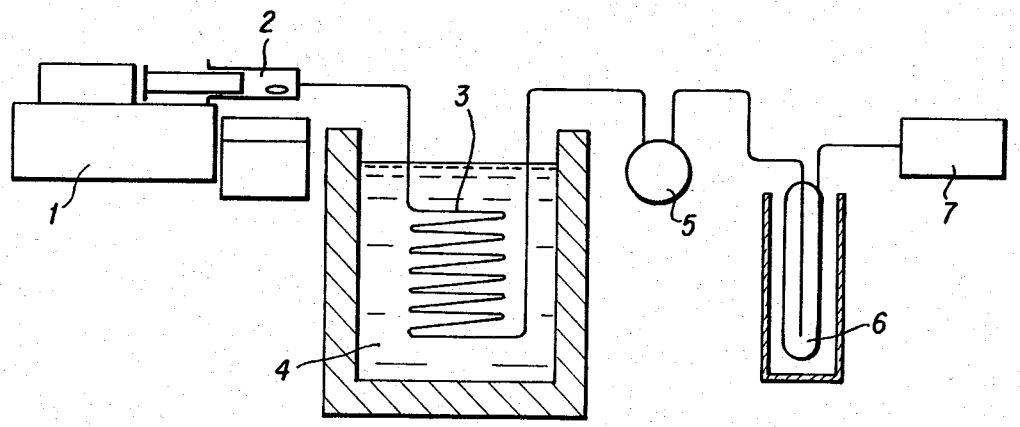
FIG. 1 CRACKING APPARATUS

SUPPRESSION OF LIGHT GAS PRODUCTION IN CRACKING PROCESSES BY THE ADDITION OF HIGHLY SILICEOUS MATERIALS HAVING HIGH SURFACE AREA AND LOW ACIDITY

BACKGROUND OF THE INVENTION

1. Field of the Invention

This invention relates to a method for suppressing the production of undesirable by-products in hydrocarbon cracking processes. More particularly, this invention relates to a method for suppressing the production of light gas by-products ordinarily produced by thermal-initiated cracking reactions. In accordance with the method of the present invention, low concentrations of highly siliceous materials, having high surface area and low acidity are dispersed within the hydrocarbon feed prior to cracking.

In the petroleum industry, the partial decomposition of hydrocarbons to those of lower molecular weight is of great importance. It was discovered early on that higher boiling hydrocarbons could be broken down or cracked, into lower boiling hydrocarbons by subjecting the former to high temperatures for extended periods. During the nineteenth century, a form of cracking was used to convert heavier crude oil fractions into kerosene. Use of cracking to produce gasoline began in 1913 and greatly increased as the automobile became popular.

Cracking which is effected by heat alone is known as thermal cracking. Thermal cracking requires temperatures ranging from about 400° to 650° C. (750° to 1200° F.). High pressures (350–1000 psi) are generally required to keep the feedstock in the liquid phase while it undergoes cracking. High pressure can also prevent vaporized hydrocarbons from being over-decomposed, forming light gases and laying down coke-like solid deposits inside the cracking unit. However, high temperatures and pressures have been found unnecessary when cracking is conducted in the presence of a catalyst. Suitable cracking catalysts include naturally occurring clays or synthetic compounds which contain silica and/or alumina. Such catalysts must provide a large surface area on which the cracking reactions can occur.

Delayed coking is another important refining process involving the breakdown of higher-boiling hydrocarbons to those of lower molecular weight. Coking is basically a thermal conversion process in which the low hydrogen-to-carbon ratio components of the residuum are converted to coke. In this process, heavy residual material residues are upgraded into more valuable distillate products and coke. A wide variety of chargestocks can be utilized in this process including full range or reduced crude oils, coal tar pitch, thermal tars, and asphalt, as well as aromatic and refractory stocks, such as catalytic cycle oils. Among the resulting products are coke, heavy and light gas oils, butane-butylene, propane-propylene, and various combinations of $C_3$ to $C_5$ fuel gas hydrocarbons.

In the delayed coking process, the charge material is rapidly heated to a temperature greater than about 482° C. (900° F.). The heated feed is then conducted to one or more coking drums for an extended period during which the breakdown into coke and other products occurs. Since the process is endothermic, sufficient heat is supplied to maintain the contents of the drums between about 438° C. and 466° C. (820° to 870° F.). When the coke reaches a predetermined level in the drum, the drum is decoked with high pressure water jets. The coke drum overhead vapor enters a fractionating tower for separation into gas, gasoline and gas oils.

High temperature visbreaking is another process whereby residual hydrocarbons are broken down into more useful products under conditions of high temperature and pressure. Vacuum residuum is conducted to a furnace and there heated to temperatures ranging from about 454° C. to 482° C. (850° to 900° F.). The heated residuum is subsequently quenched with light gas oil and transferred to a flash zone in a fractionator tower. The flashing procedure breaks the residuum into dry gas (less than about 3% by weight), gasoline (about 3–10% by weight), gas oil (about 10–20% by weight) and visbroken residuum having a boiling point higher than about 343° C. (650° F.) (about 68–86% by weight). The product proportions can be varied by altering the reaction conditions.

Thermal cracking, delayed coking, and high temperature visbreaking processes all produce light gases, i.e., the $C_1$ to $C_2$ hydrocarbons such as methane, ethane and ethylene. In order to derive the greatest economic benefit from a feedstock, it is desirable to minimize the production of low molecular weight hydrocarbons products in order to maximize production of more valuable longer chain hydrocarbons. In view of the enormous amounts of crude oil which are treated by cracking, coking, or visbreaking processes, even a slight reduction in light gas produced would result in a significant economic advantage.

Two competing reactions are believed to occur in the above thermal processes. Carbonium ion-promoted reactions tend to produce molecules having three or more carbon atoms, while free radical reactions generally form one or two carbon molecules, such as methane and ethane. Because the more economically desirable molecules are promoted by the carbonium ion reaction, a method for suppressing the competing free radical reactions would likely reduce production of less desirable lighter hydrocarbon products. Such a reduction in free radical-promoted reactions would serve to increase the overall yield of $C_3$ or greater molecules depending on the cracking temperatures.

It is known in the art to add certain components to a chargestock in order to affect the product output of a catalytic cracking process. For instance, U.S. Pat. No. 3,849,291 to Owen discloses a method of high temperature catalytic cracking with low coke-producing crystalline zeolite catalysts wherein crystalline aluminosilicate catalytic compositions are suspended in gasiform material comprising hydrocarbon reactant material. The suspended additive serves to reduce the coke make of this catalytic cracking process. However, no chargestock additive is known in the art which serves to suppress the production of light gas in high temperature cracking processes.

SUMMARY OF THE INVENTION

Accordingly, the present invention relates to an improved process for reducing light gas production in high temperature thermal processes of petroleum refining. This reduction contributes to an overall increase in yield for larger hydrocarbons by the addition of a small amount of highly siliceous catalyst material having high surface area and low acidity in the chargestock prior to thermal treatment. This added material functions as a free radical scavenger which reduces the amount of light gas produced by free radical-promoted reactions. Suitable reactor conditions for the process of the present invention include temperatures ranging from about 400° to 650° C. (750° to 1200° F.); feed rates ranging from about 0.25 to 25 $hr^{-1}$, preferably about 3.5 $hr^{-1}$; and pressures ranging from about 0 to 100 psig, for example, atmospheric pressure.

The process of this invention relies to a large part on the high surface area-to-mass ratio of the catalyst employed. This property contributes to the efficiency of such catalysts as free radical scavengers. It has been found that catalyst materials advantageously used in the present invention have a surface area-to-mass ratio of at least about 100 $m^2/g$. In addition to their high surface area, the catalyst materials used in the process of the present invention possess sufficiently low acid activity to promote the formation of carbonium ions responsible for producing gasoline and distillate range hydrocarbon products from the heavier components of the feed.

The catalyst employed in the present invention can be any highly siliceous material of high surface area and low acid activity comprising at least about 98% by weight of silica. For example, pure silicon dioxide having a surface area of about 116 $m^2/g$ and a particle diameter less than about 32 microns, reduces the production of lighter hydrocarbons during thermal cracking while enhancing the production of heavier hydrocarbons.

Preferably, highly siliceous crystalline zeolite catalyst materials, having a silica to alumina ratio of at least about 50 are employed in the present invention.

The silica:alumina ratios referred to in this specification are the structural or framework ratios, that is, the ratio for the $SiO_4$ to the $AlO_4$ tetrahedra which together constitute the structure of which the zeolite is composed. This ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ratio is determined by thermogravimetric analysis (TGA) of ammonia desorption, a low ammonia titration may be obtained if cationic aluminum prevents exchange of the ammonium ions onto the acidic sites. These disparities are particularly troublesome when certain treatments such as dealuminization methods which result in the presence of ionic aluminum free of the zeolite structure are employed. Due care should therefore be taken to ensure that the framework silica:alumina ratio is correctly determined.

Mordenite or faujasite zeolites such as zeolite X and zeolite Y which can be dealuminated to zeolites having a silica-to-alumina ratio ranging from about 50 to 1000 are of particular utility in the present invention. Zeolite X faujasites which can be dealuminated for use in the present invention have a typical formula of $$M_{86/n}(AlO_2)_{86}(SiO_2)_{106},$$

while their higher silica analogues, zeolite Y faujasites, have a typical formula of $M_{57/n}(AlO_2)_{57}(SiO_2)_{135}$, where M is a metal cation and n is the valence of the metal cation. The highly siliceous crystalline zeolite catalyst materials employed in the present invention may be made by dealuminating zeolites according to conventional processes. See, e.g. J. Scherzer, "Dealuminated Faujasite-Type Structures with $SiO_2/Al_2O_3$ Ratios over 100", *J. Catal.* 54, 285 (1978) and P. E. Eberly, S. M. Laurent, and H. E. Robson, "High Silica Crystalline Zeolites and Process for their Preparation", U.S. Pat. No. 3,506,400 (1970).

As noted above, the highly siliceous materials employed in the present invention require sufficiently low acid activity in order to reduce the production of light hydrocarbons. Materials having an acid activity less than about 0.1 meq $NH_3$ per 100 grams of catalyst, preferably less than about 0.05 meq $NH_3$ per 100 grams of catalyst as measured by the thermogravimetric ammonia desorption method disclosed in B. Gates, J. Katzer and G. C. A. Schuit, Chemistry of Catalystic Processes, McGraw Hill, N.Y. (1979), p. 19, are suitable for the present invention.

The highly siliceous catalyst material can be directly introduced to either the cold or preheated cracking chargestock as a finely divided powder having a particle size of about 0.5 to 200 microns, preferably about 32 microns or less. Generally, concentrations of about 0.01% to 5%, preferably less than about 1% catalyst material by weight in the chargestock have been found suitable for the present process.

In order to enhance the operating economy of the present invention, the zeolite catalyst may be recovered from the reactor and product stream by conventional methods, e.g., employing a settling tank or other agglomerating means.

The FIGURE depicts an apparatus for thermally cracking a hydrocarbon feed in accordance with the present invention.

DESCRIPTION OF THE PREFERRED EMBODIMENTS

In one embodiment of the present invention depicted in the FIGURE, the 343° to 482° C. (650° F. to 900° F.) cut of a heavily hydrotreated Arab Light resid feed having a combined Ni and V content of less than 0.1 ppm was combined with about 1% by weight of a high silica-to-alumina faujasite having a framework silica-to-alumina ratio of about 75. The feed mixture was then transported by infusion pump 1 equipped with a magnetic stirrer 2 through a coiled reactor 3 immersed in an isothermal sand bath 4, maintained at a temperature of about 510° C. (950° F.). Upon leaving the reactor, the product stream passed through liquid receiving flask 5 where higher boiling liquids (bp about 21° C. to 510° C. (70° to 950° F.)) condensed, and thence to a dry ice trap 6 where lower boiling liquids were recovered. The remaining stream then passed to a gas collector 7. Feed was passed through the system at 100 cc/hour and the liquid hourly space velocity in terms of volume feed per hour/open volume of the reactor (LHSV) was maintained at about 3.3/hour. Another run was made under the same conditions except that no faujasite was mixed in the feed. The data obtained from both of these runs are set out in Table 1, Columns 1 and 2, respectively.

Analysis of the products produced from both the experimental and control runs indicated that several significant improvements resulted from the presence of faujasite in the feed. The gas yield of the faujasite-containing feed was only about 38% that of the feed containing no catalyst (1.05% versus 2.74%). A comparison of overall conversion yields showed an improvement in the conversion from liquid, gas and coke to products having a boiling point of about 343° C. (650° F.) (9.56% versus 5.88%). The propane-to-methane ratios of both feeds were calculated in order to indicate the relative rates of carbonium ion-promoted reactions to free radical promoted reactions. The product of the catalyst-containing feed also exhibited a higher propane-to-methane ratio compared to the control products (0.77% versus 0.20%). Such data suggest that at temperatures of about 510° C. (950° F.), the high surface area-to-volume ratio of the catalyst inhibits free radical-promoted reactions by scavenging free radicals. At the same time, the data indicate that the acidic properties of the faujasite promote carbonium ion reactions which convert heavier feed components into propane, gasoline and distillate range materials. In the catalyst-containing run, methane production was only about 17.5% that of the control run (See Table 2). Finally, the ratio of isobutane to n-butane is higher in the faujasite-containing feed. A more complete exposition of the experimental results is found in Table 1.

TABLE 1

Thermal Cracking of Severely Hydrotreated Arab Light Resid

| | 1 | 2 | 3 FEED of 1 & 2 | 4 | 5 | 6 FEED of 4 & 5 | 7 | 8 | 9 FEED of 7 & 8 |
|---|---|---|---|---|---|---|---|---|---|
| Additive Material | Faujasite Y* | None | | $SiO_2$** | None | | $SiO_2$** | None | |
| Wt. % of Additive | 1% | — | | 1% | — | | 1% | — | |
| Temperature °C. (°F.) | (510(950) | 510(950) | | 627(1160) | 627(1160) | | 621(1150) | 621(1150) | |
| LHSV, $Hr^{-1}$ | 3.33 | 3.33 | | 0.96 | 0.96 | | 18.3 | 18.3 | |
| Pressure | ATM | ATM | | ATM | ATM | | ATM | ATM | |
| Grams of Liquid Fed | 23.2 | 21.7 | | 9.3 | 17.7 | | 20.8 | 19.8 | |
| Grams of Liquid Collected | 22.6 | 21.16 | | 8.7 | 16.1 | | 20.4 | 19.1 | |
| Grams of Gas Collected | 0.24 | 0.61 | | 0.494 | 1.28 | | 0.09 | 0.133 | |
| CC of Gas collected | 130 | 250 | | 390 | 1000 | | 73 | 105 | |
| Grams of Coke Collected | 0.023 | 0.022 | | — | — | | — | — | |
| Mass Balance | 98.4 | 100.5 | | 99.5 | 98.2 | | 98.5% | 97% | |
| % Gas | 1.05 | 2.80 | | 54 | 7.36 | | 0.43 | 0.69 | |
| % Liquid | 98.9 | 97.2 | | 94.6 | 92.64 | | 99.57 | 99.31 | |
| Gas/Liquid $\times 10^3$ | 10.6 | 28.8 | | 57.1 | 79.45 | | 4.3 | 6.9 | |
| Product Analysis Wt. % | | | | | | | | | |
| Methane | 0.160 | 0.912 | | 0.7575 | 1.013 | | 0.083 | 0.094 | |
| Ethane & Ethylene | 0.249 | 0.534 | | 1.818 | 2.992 | | 0.164 | 0.237 | |
| Propane | 0.123 | 0.186 | | 0.246 | 0.331 | | 0.022 | 0.036 | |
| Propylene | 0.338 | 0.764 | | 1.089 | 1.568 | | 0.094 | 0.147 | |
| I—Butane | 0.012 | 0.040 | | 0.016 | 0.010 | | $7 \times 10^{-4}$ | $8 \times 10^{-4}$ | |
| N—Butane | 0.025 | 0.147 | | 0.037 | 0.043 | | $2.6 \times 10^{-3}$ | $4.9 \times 10^{-3}$ | |
| Butenes | 0.143 | 0.209 | | 0.786 | 0.940 | | 0.041 | 0.094 | |
| IBP ($C_{5+}$) to 216° C. | 0.198 | 0.000 | 0.00 | 2.24 | 3.206 | | 2.42 | 0.379 | |
| 216° to 343° C. | 8.856 | 3.777 | 0.71 | 61.63 | 57.04 | 53.23 | 52.87 | 56.42 | 53.23 |
| 343° to 454° C. | 81.580 | 86.040 | 90.08 | 31.37 | 32.95 | 46.77 | 44.31 | 42.59 | 46.77 |
| 454° to 579° C. | 8.274 | 7.282 | 9.21 | — | — | | — | — | |
| 579° C. + | — | — | 0.00 | — | — | | — | — | |
| Selectivities and Conversions | | | | | | | | | |
| Propane/Methane (Wt./Wt.) | 0.267 | 0.204 | | 0.3243 | 0.326 | | 0.2695 | 0.3751 | |
| $IC_4/N—C_4$(Wt/Wt.) | 0.469 | 0.315 | | 0.4399 | 0.232 | | 0.2966 | 0.1932 | |
| 216° C. - Conversion (%) | 1.35 | 2.91 | | 7.00 | 10.01 | | 2.82 | 0.99 | |
| 343° C. - Conversion (%) | 9.44 | 9.56 | | 32.93 | 29.55 | | 5.26 | 8.94 | |

*High $SiO_2/Al_2O_3Y$ (Framework $SiO_2/Al_2O_2 = 75$)
**Surface Area = 116 $m^2/g$ A 215° to 430° C. (420° to 800° F.) cut of the same hydrotreated Arab Light resid was treated with about 1% by weight of pure $SiO_2$ having a surface area of about 116 $m^2/g$. Both treated and untreated runs were made under two sets of conditions. The first set employed temperatures of about 627° C. (1160° F.), an LHSV of about 0.96 $hr^{-1}$, and atmospheric pressure (see Table 1, columns 4 and 5). The second set employed temperatures of about 621° C. (1150° F.). an LHSV of about 18.3 $hr^{-1}$ and atmospheric pressure (see Table 1, columns 7 and 8). The addition of silica under both sets of conditions resulted in reduced gas make (5.4% v. 7.36% for runs 4 and 5 and 0.43% v. 0.69% for runs 7 and 8). A comparison of the production of $C_1$ to $C_4$ hydrocarbons for treated and untreated feeds is set out in Table 2.

TABLE 2

Weight Percent of $C_1$ to $C_4$ Products (Treated Feed)/ Weight Percent of $C_1$ to $C_4$ Products (Untreated Feed) $\times$ 100%

| Products | Runs 1 and 2 | Runs 4 and 5 | Runs 7 and 8 |
|---|---|---|---|
| Methane | 17.5% | 74.7% | 88.3% |
| Ethane and Ethylene | 46.6% | 60.7% | 69.1% |
| Propane | 66.1% | 74.3% | 61.1% |
| Propylene | 44.2% | 69.5% | 57.1% |
| I—Butane | 30.0% | 160.0% | 87.5% |
| N—Butane | 17.0% | 86.0% | 53.1% |
| Butenes | 68.4% | 93.6% | 43.6% |

What is claimed is:

1. In a process for reducing light hydrocarbon production and increasing the overall yield of gasoline and distillate range products in a high temperature thermal process which employs temperatures ranging from about 510° C. to 650° C., the improvement which comprises adding to the hydrocarbon chargestock about 0.01 to 5 percent by weight of a highly siliceous zeolite catalyst material having a silica-to-alumina ratio of at least about 50 comprising at least about 98% by weight of silica having a particle diameter ranging from about 0.5 to 200 microns and a surface area of at least about 100 $m^2/g$ of catalyst material.

2. The process of claim 1 wherein the high temperature thermal process employs an LHSV ranging from about 0.25 to 25 $hr^{-1}$, and pressures ranging from about 0 to 100 psig.

3. The process of claim 1 wherein about one percent by weight of the highly siliceous catalyst material is added to the hydrocarbon chargestock.

4. The process of claim 1 wherein the highly siliceous catalyst material is a crystalline zeolite having a silica-to-alumina ratio ranging from about 50 to 1000 and an acid activity of less than about 0.1 meq $NH_3$ per 100 g of catalyst as measured by thermogravimetric ammonia desorption.

5. The process of claim 4 wherein the crystalline zeolite material is mordenite.

6. The process of claim 4 wherein the crystalline zeolite material is faujasite.

7. The process of claim 6 wherein the faujasite has a silica-to-alumina ratio of about 50, and an acid activity of less than about 0.05 meq $NH_3$ per 100 g of catalyst.

8. The process of claim 7 wherein the faujasite has a framework silica-to-alumina ratio of about 75 to 1,000.

9. The process of claim 8 wherein the particle diameter of the crystalline zeolite is less than about 32 microns.

10. The process of claim 7 wherein about 1 percent of crystalline zeolite material is added to the chargestock.

11. The process of claim 1, 4, 7 or 9 wherein the catalyst material is added to a preheated hydrocarbon chargestock.

12. The process of claim 1, 4, 7 or 9 wherein the high temperature thermal process is thermal cracking.

13. The process of claim 1, 4, 7 or 9 wherein the high temperature thermal process is operated in a high temperature fluidized catalytic cracking unit.

* * * * *